US008220191B2

(12) United States Patent
Waltersdorf

(10) Patent No.: US 8,220,191 B2
(45) Date of Patent: Jul. 17, 2012

(54) WRISTBAND ASSEMBLY

(75) Inventor: Bryan M. Waltersdorf, Oconomowoc, WI (US)

(73) Assignee: Artemax, Inc., Brookfield, WI (US)

( * ) Notice: Subject to any disclaimer, the term of this patent is extended or adjusted under 35 U.S.C. 154(b) by 0 days.

(21) Appl. No.: 12/952,443

(22) Filed: Nov. 23, 2010

(65) Prior Publication Data

US 2012/0124877 A1 May 24, 2012

(51) Int. Cl.
*A44C 5/00* (2006.01)

(52) U.S. Cl. ..... 40/633

(58) Field of Classification Search ..... 40/633; 283/75, 101

See application file for complete search history.

(56) References Cited

U.S. PATENT DOCUMENTS

| | | | | |
|---|---|---|---|---|
| 3,197,899 | A * | 8/1965 | Twentier | 40/633 |
| 4,682,431 | A * | 7/1987 | Kowalchuk | 40/633 |
| 5,457,906 | A * | 10/1995 | Mosher, Jr. | 40/633 |
| 5,645,300 | A * | 7/1997 | Hill | 283/81 |
| 5,700,537 | A | 12/1997 | Instance | |
| 6,782,648 | B1 | 8/2004 | Mosher, Jr. | |
| 6,783,830 | B2 | 8/2004 | Cohen et al. | |
| 7,316,358 | B2 | 1/2008 | Kotik et al. | |
| 7,320,194 | B2 | 1/2008 | Ali et al. | |
| 7,520,078 | B2 | 4/2009 | Ali et al. | |
| 7,752,794 | B2 | 7/2010 | Kerlin | |
| 2002/0073587 | A1 * | 6/2002 | Twentier | 40/633 |
| 2004/0265530 | A1 * | 12/2004 | Cohen et al. | 428/40.1 |
| 2010/0058636 | A1 | 3/2010 | Kerlin | |
| 2010/0242324 | A1 | 9/2010 | Waltersdorf | |

* cited by examiner

*Primary Examiner* — Gary Hoge

(74) *Attorney, Agent, or Firm* — Michael Best & Friedrich LLP

(57) ABSTRACT

A wristband assembly comprising a wristband strap having a first portion, a second portion, and a fold line between the first portion and the second portion. The wristband strap is in a folded position with the first portion folded in overlapping relation with the second portion. A release layer is positioned on the first portion, and an adhesive is positioned on the second portion in releasable engagement with the release layer. Preferably, substantially the entire release layer is secured to the strap by a permanent adhesive. In use, the wristband assembly is provided to the user in the folded position. The assembly is used by disengaging the adhesive from the release layer, unfolding the first portion relative to the second portion, forming the strap into a loop, and engaging the adhesive with a surface of the strap. Preferably, the length of the assembly is increased when unfolding the assembly.

18 Claims, 3 Drawing Sheets

WRISTBAND ASSEMBLY

BACKGROUND

The present invention generally relates to wristbands, and specifically to wristbands having an adhesive for securing the wristband in a loop.

Wristbands are commonly used as a means for identifying an individual. For example, wristbands can be used to identify individuals that are authorized to be in a certain location (e.g., at a concert or a park) or to consume certain food or beverages (e.g., at a party), such as alcoholic beverages. Wristbands are commonly of a certain color or imprinted pattern to facilitate visual identification at a distance.

Some wristbands include an adhesive layer on one end in order to facilitate closing the wristband in a loop around the user's wrist or ankle. During the manufacture of these wristbands, adhesive is applied to one end of the wristband, and a non-adhesive liner is placed over the adhesive in order to prevent the adhesive from sticking to something during shipment to the user. For example, such liners are commonly made from a sheet of material (e.g., paper or plastic) that is coated with a silicone layer that provides temporary adhesion to the adhesive. That is, the silicone layer will lightly adhere to the adhesive, but can be easily peeled from the adhesive layer when the user desires to use the wristband.

Upon removal of the liner, it is desirable to throw the liner into the trash. However, trash receptacles are not always readily available, and thus it is common for the user to either put the liner in a pocket or throw it on the ground, neither of which is desirable.

U.S. Pat. No. 5,457,906 discloses a wristband having adhesive for closing the wristband, and a liner that is permanently affixed to the adhesive. This is beneficial in that it keeps the liner attached to the wristband, which precludes the need to find an appropriate place to dispose of the liner. In use, the liner is peeled away from a portion of the adhesive and then bent backward to lie flat on the inside surface of the wristband.

SUMMARY OF THE INVENTION

The present invention provides a wristband assembly comprising a wristband strap (e.g., including a unitary spunbonded plastic) having a first portion, a second portion, and a fold line between the first portion and the second portion, wherein the wristband strap is in a folded position with the first portion folded in overlapping relation with the second portion. A release layer (e.g., including a silicone-coated tape) is positioned on the first portion of the strap, and an adhesive (e.g., permanent adhesive) is positioned on the second portion of the strap in releasable engagement with the release layer. Preferably, the assembly has a first length in the folded position, and the strap can be moved to an unfolded position by moving the first portion out of engagement with the second portion, wherein the assembly in the unfolded position has a second length longer than the first length.

In one embodiment, the wristband strap includes a first part comprising a first material (e.g., spunbonded plastic) and a second part secured to the first part and comprising a second material (e.g., polyester tape) different than the first material. In this embodiment, the release layer and the adhesive layer can be both positioned on the second part. Preferably, substantially the entire release layer is secured to the strap by a permanent adhesive.

In use, the above-reference wristband assembly is provided to the user in the above-described folded position. The assembly is used by disengaging the adhesive from the release layer, unfolding the first portion relative to the second portion, forming the strap into a loop, and engaging the adhesive with a surface of the strap. Preferably, the length of the assembly is increased when unfolding the assembly. In addition, when substantially the entire release layer is secured to the strap, such engagement is preferably maintained after disengaging the adhesive from the release layer.

DETAILED DESCRIPTION

Figure 1:
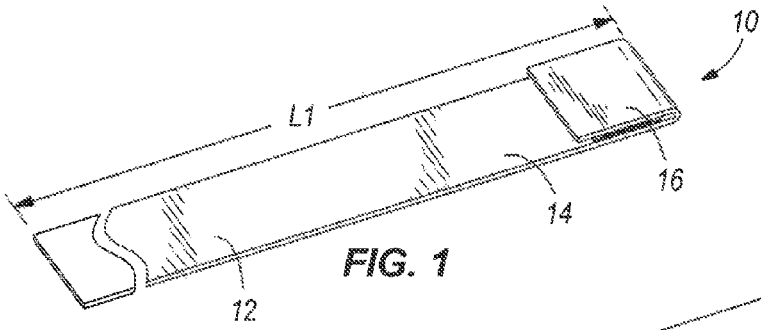
FIG. 1 is a perspective view of a wristband assembly embodying one aspect of the present invention.

FIGS. 1-4 illustrate a wristband assembly 10 including a wristband strap 12 including a first portion 14, a second portion 16, and a fold line 18 between the first portion 14 and the second portion 16. A release layer 20 is positioned on the first portion 14, and a closure in the form of adhesive 22 is positioned on the second portion 16. The strap 12 is designed to wrap around and secure to an item or person (e.g., a person's wrist or ankle), as is known in the art. The strap can be made from any of a variety of appropriate materials, such as paper, plastic, spun plastic (e.g., spunbonded olefin such as Tyvek®, a trademark of E.I. DuPont de Nemours), or a composite. Further, the strap 12 can be sized and shaped as desired. The illustrated strap has a thickness of 0.007 inches.

Figure 4:
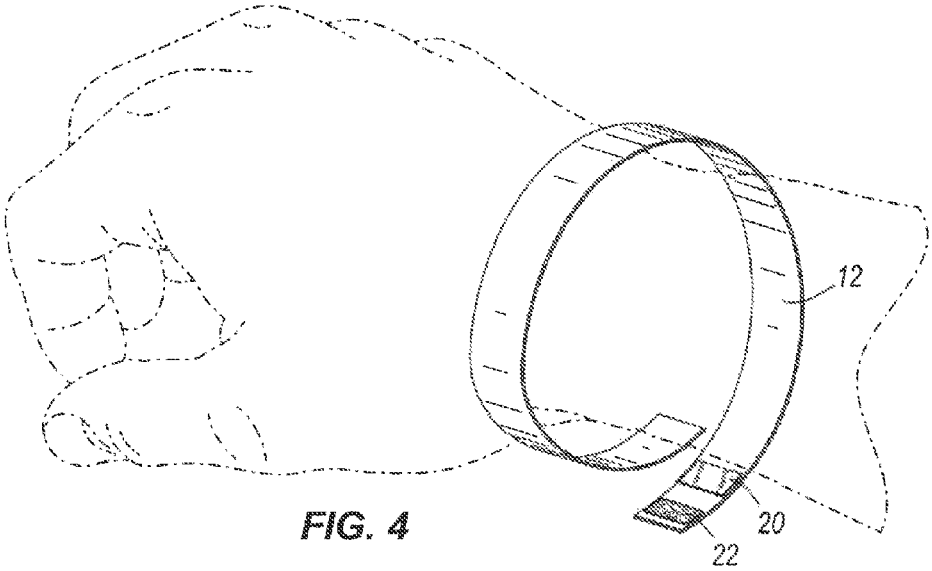
FIG. 4 is a perspective view of the wristband assembly of FIG. 4 wrapped around a user's wrist.
Figure 5:
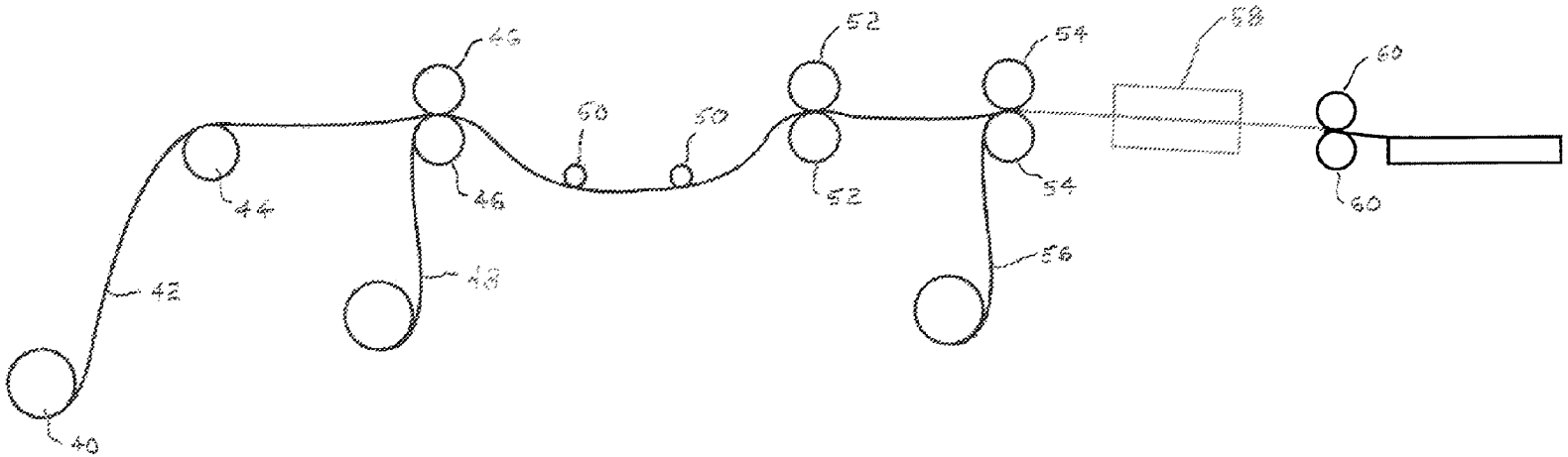
FIG. 5 is a schematic view of a mechanism for creating the wristband assembly of FIGS. 1-4.

The adhesive 22 is positioned near one end of the strap 12 and provides a mechanism for securing that end of the strap 12 to another portion of the strap 12 in order to form a loop around an object, as is known in the art (see FIG. 4). The illustrated adhesive covers the full width of the strap and is shaped in a rectangular configuration. The adhesive is spaced slightly from the end of the strap 12 to provide a flap 24 that facilitates engagement by the user. The illustrated adhesive is a 0.003 inch think permanent adhesive that will securely hold two parts together, and makes separation of the two parts very difficult without causing damage to at least one of the two parts. The adhesive 22 could be any suitable adhesive, such as a modified acrylic composition, a rubber-based adhesive, and the like. In the illustrated embodiment, the adhesive is supplied as a double-coated tape with permanent adhesive on both sides.

Figure 2:
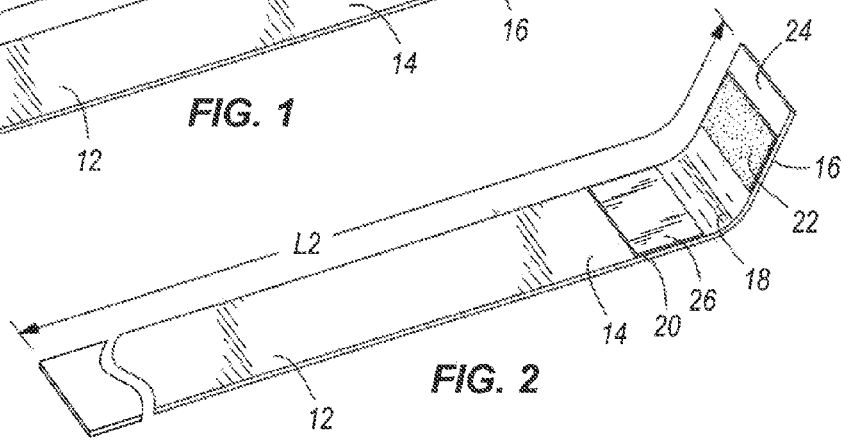
FIG. 2 is a perspective view of the wristband assembly in FIG. 1 in an unfolded position.
Figure 3:
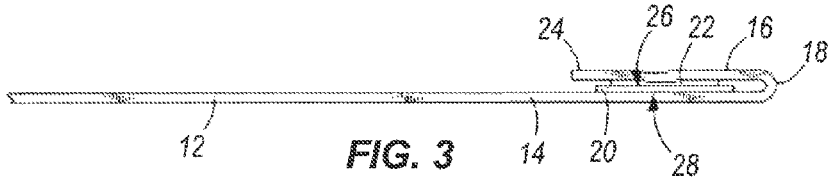
FIG. 3 is a side view of the wristband assembly in FIG. 2.

The release layer 20 facilitates releasable engagement with the adhesive 22 such that the band can be held in the folded position (FIGS. 1 and 3) and opened to the unfolded position (FIGS. 2 and 4). The illustrated release layer 20 is a silicone coating, but could be any suitable layer that facilitates the release from the adhesive 22. In the illustrated embodiment, the release layer 20 is supplied as a double-coated polyester tape with a silicone coating on the top side 26 and a permanent adhesive on the bottom side 28 (engaged with the strap 12).

The wristband assembly 10 is supplied to the user in the folded position (FIG. 1), with the adhesive 22 releasably engaged with the release layer 20. In this position, the wristband assembly 10 has a folded length L1. To use the wristband assembly 10, the user grasps the flap 24 and pulls the adhesive 22 out of engagement with the release layer 20 such that the second portion 16 of the strap 12 is unfolded relative to the first portion 14 of the strap 12, thereby placing the wristband assembly 10 in an unfolded position having an unfolded length L2 that is longer than the folded length L1. The wristband strap 12 is then formed into a loop around an object (FIG. 4), and the adhesive 22 is brought into contact with an outer surface of the strap 12 to secure the wristband assembly 10 into the object.

Figure 6:
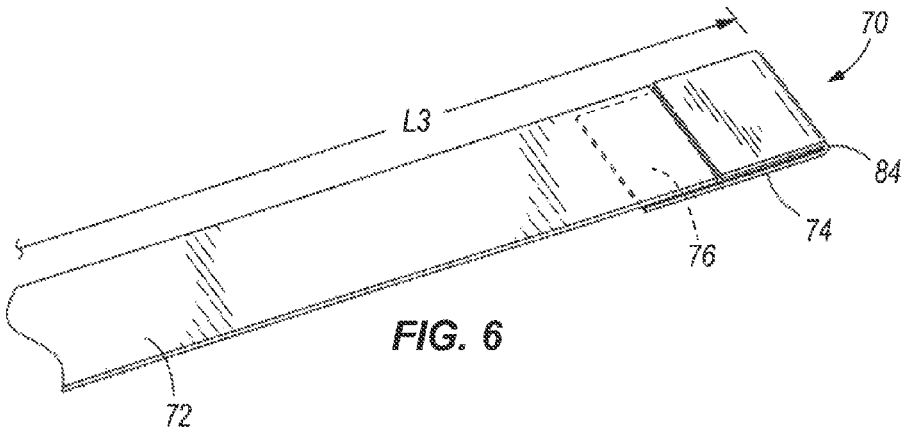
FIG. 6 is a perspective view a wristband assembly embodying another aspect of the present invention.

The above-described wristband assembly can be manufactured with a machine that is schematically illustrated in FIG. 6. The machine starts with a roll 40 of Tyvek® material that is pulled off in a web 42 and passed over a roller 44. The web 42 is moved into the nip of laminating rolls 46, and a release tape 48 (which will form the release layer 20), having adhesive on one side and silicone on the other, is brought into contact with the web 42 spaced from the edge of the web 42. The web 42 is then passed under two idler rolls and through a destruction die. The web 42 is then moved through the nip of another laminating roll 54, and adhesive tape 56 (which includes the above-referenced adhesive 22) having adhesive on both sides is brought into contact with the web 42 between the release tape 48 and the edge of the web 42. The web 42 then passes through a folder 58 that folds the adhesive tape 56 into engagement with the release tape 48. The folded web then passes through a sheet cutter 60, where the web is perforated into distinct but connected wristbands.

Figure 7:
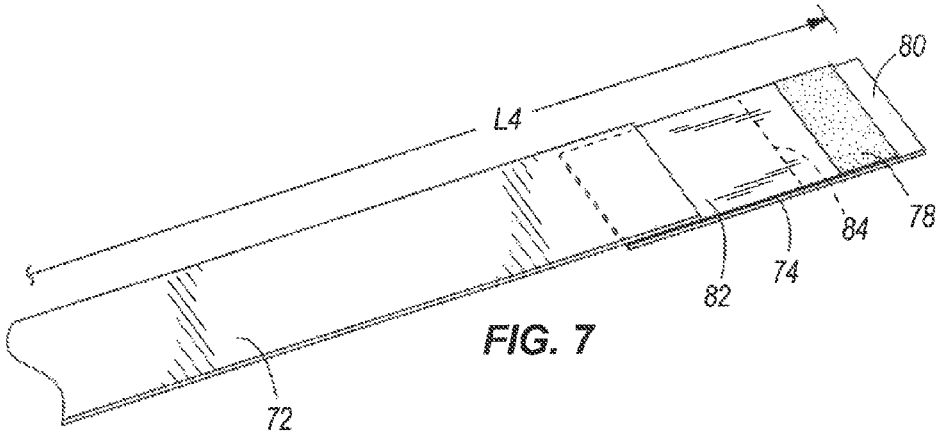
FIG. 7 is a perspective view of the wristband assembly in FIG. 6 in an unfolded position.
Figure 8:
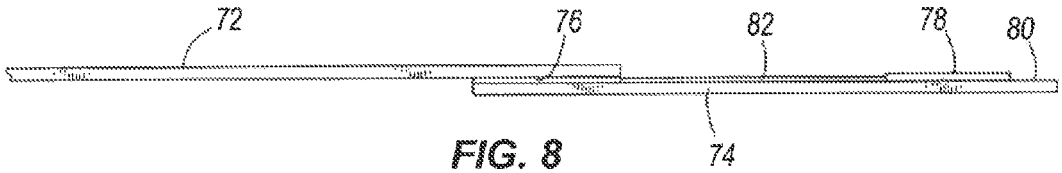
FIG. 8 is a side view of the wristband assembly in FIG. 7.

FIGS. 6-8 illustrate a different wristband assembly 70 having a wristband strap that is made in two parts (contrary to the unitary structure of the strap 12 in FIGS. 1-4). A first part 72 of the strap is similar to the above-described strap 12 and is made of a typical wristband strap material, such a Tyvek, and has a thickness of about 0.007 inches. The second part 74 of the strap is made of a polyester tape having a permanent first adhesive 76 that secures the second part 74 in overlapping relation to the first part 72, and having a thickness of about 0.001-0.002 inches. As such, the overlapping tape adds only about 14.3%-28.6% to the thickness of the strap 12 (i.e., 0.001-0.002 inches added to a 0.007 inch thick strap). The second part 74 further includes a permanent second adhesive 78 spaced from the permanent first adhesive 76 and spaced from an end of the second part 74 to form an engagement flap 80. A release layer 82 is positioned between the first and second adhesives 76,78. The illustrated release layer 82 is a silicone coating.

Prior to being used, the second part 74 of the strap is folded (FIG. 6) along a fold line 84 such that the second adhesive 78 is in contact with the release layer 82. In this folded condition, the wristband assembly 70 has a folded length L3. Prior to wrapping the wristband assembly 70 around an object, the flap 80 is engaged to peel the second adhesive 78 away from the release layer 82 and unfold the strap (FIG. 7), thereby exposing the second adhesive 78. In this unfolded condition, the wristband assembly 70 has an unfolded length L4 that is longer than the folded length L3. The wristband assembly 70 can then be wrapped around an object and secured into a loop by contacting the second 78 with an outer surface of the first part 72 of the strap.

It is noted that the drawings in this application are schematic in nature, and are not drawn to scale. In addition, in some drawings, section lines have been removed for clarity.

The invention claimed is:

1. A wristband assembly comprising:

a wristband strap having a first portion, a second portion, and a fold line between the first portion and the second portion, wherein the wristband strap is in a folded position with the first portion folded in overlapping relation with the second portion, and wherein the wristband strap includes a first part comprising a spunbonded plastic and a second part secured to the first part and comprising a tape different than the spunbonded plastic;

a release layer positioned on the first portion of the strap; and an adhesive positioned on the second portion of the strap, the adhesive being in releasable engagement with the release layer.

2. A wristband assembly as claimed in claim 1, wherein the adhesive is spaced from an end of the strap to form an engagement flap.

3. A wristband assembly as claimed in claim 1, wherein the adhesive comprises a permanent adhesive.

4. A wristband assembly as claimed in claim 1, wherein the fold line defines an end of the strap when the strap is in the folded position.

5. A wristband assembly as claimed in claim 1, wherein the assembly has a first length in the folded position, and wherein the strap can be moved to an unfolded position by moving the first portion out of engagement with the second portion, wherein the assembly in the unfolded position has a second length longer than the first length.

6. A wristband assembly as claimed in claim 1, wherein substantially the entire release layer is secured to the strap by a permanent adhesive.

7. A wristband assembly comprising:

a wristband strap having a first portion, a second portion, and a fold line between the first portion and the second portion, wherein the wristband strap is in a folded position with the first portion folded in overlapping relation with the second portion, wherein the wristband strap includes a first part comprising a first material and a second part secured to the first part and comprising a second material different than the first material, and wherein the release layer and the adhesive layer are both positioned on the second part;

a release layer positioned on the first portion of the strap; and an adhesive positioned on the second portion of the strap, the adhesive being in releasable engagement with the release layer.

8. A wristband assembly as claimed in claim 7, wherein the adhesive is spaced from an end of the strap to form an engagement flap.

9. A wristband assembly as claimed in claim 7, wherein the adhesive comprises a permanent adhesive.

10. A wristband assembly as claimed in claim 7, wherein the fold line defines an end of the strap when the strap is in the folded position.

11. A wristband assembly as claimed in claim 7, wherein the assembly has a first length in the folded position, and wherein the strap can be moved to an unfolded position by moving the first portion out of engagement with the second portion, wherein the assembly in the unfolded position has a second length longer than the first length.

12. A wristband assembly as claimed in claim 7, wherein substantially the entire release layer is secured to the strap by a permanent adhesive.

13. A wristband assembly comprising:

a wristband strap having a first portion, a second portion, and a fold line between the first portion and the second portion, wherein the wristband strap is in a folded position with the first portion folded in overlapping relation with the second portion;

a release layer positioned on the first portion of the strap and comprising a silicone coating supported by a tape adhered to the first portion; and an adhesive positioned on the second portion of the strap, the adhesive being in releasable engagement with the release layer.

14. A wristband assembly as claimed in claim 13, wherein the adhesive is spaced from an end of the strap to form an engagement flap.

15. A wristband assembly as claimed in claim 13, wherein the adhesive comprises a permanent adhesive.

16. A wristband assembly as claimed in claim 13, wherein the fold line defines an end of the strap when the strap is in the folded position.

17. A wristband assembly as claimed in claim 13, wherein the assembly has a first length in the folded position, and wherein the strap can be moved to an unfolded position by moving the first portion out of engagement with the second portion, wherein the assembly in the unfolded position has a second length longer than the first length.

18. A wristband assembly as claimed in claim 13, wherein substantially the entire release layer is secured to the strap by a permanent adhesive.

* * * * *